US008729415B2

(12) United States Patent
Chen

(10) Patent No.: US 8,729,415 B2
(45) Date of Patent: May 20, 2014

(54) POWER SWITCH SUITABLE FOR AUTOMATED PRODUCTION

(76) Inventor: Tsan-Chi Chen, New Taipei (TW)

( * ) Notice: Subject to any disclaimer, the term of this patent is extended or adjusted under 35 U.S.C. 154(b) by 206 days.

(21) Appl. No.: 13/291,483

(22) Filed: Nov. 8, 2011

(65) Prior Publication Data

US 2013/0112540 A1 May 9, 2013

(51) Int. Cl.
*H01H 9/00* (2006.01)
*H01H 21/00* (2006.01)
*H01H 3/00* (2006.01)

(52) U.S. Cl.
USPC ..... 200/553; 200/315; 200/339; 337/66

(58) Field of Classification Search
CPC ..... H01H 21/00; H01H 9/00; H01H 3/00
USPC ..... 200/553, 315, 339
See application file for complete search history.

(56) References Cited

U.S. PATENT DOCUMENTS 3,435,169 A * 3/1969 Bienwald et al. ..... 200/315
3,609,268 A * 9/1971 Sanchez ..... 200/315
4,167,720 A * 9/1979 Krasser ..... 337/60
5,079,530 A * 1/1992 Tsuchiyama ..... 335/17
5,223,813 A * 6/1993 Cambreleng et al. ..... 337/66
5,539,371 A * 7/1996 Yu ..... 337/66
6,275,134 B1 * 8/2001 Chen ..... 337/37
6,400,250 B1 * 6/2002 Wang ..... 337/66
6,452,125 B1 * 9/2002 Yu ..... 200/553
6,590,175 B1 * 7/2003 Lam ..... 200/315
6,815,626 B1 * 11/2004 Hsu ..... 200/315
6,833,521 B2 * 12/2004 Nishikawa ..... 200/339
7,232,971 B2 * 6/2007 Chen ..... 200/460
7,688,174 B2 * 3/2010 Hung ..... 337/66
7,982,577 B2 * 7/2011 Yu ..... 337/66

* cited by examiner

*Primary Examiner* — Renee Luebke
*Assistant Examiner* — Ahmed Saeed
(74) *Attorney, Agent, or Firm* — Bacon & Thomas, PLLC

(57) ABSTRACT

The present invention relates to a power switch, which includes a housing, a key pivotally connected to the housing, a first conductive plate having one end in the housing, a thermally actuated metal plate having one end fixed to the first conductive plate and a free end extending within the housing, a C-shaped spring having two ends engaged with the thermally actuated metal plate, a second conductive plate having one end in the housing, an insulating seat accommodated in the housing, a light-emitting unit located in the key and having two electrodes connected to the insulating seat, and a third conductive plate having one end in the housing. Thus, the light-emitting unit can be easily installed in the housing along with the insulating seat, and the electrodes can directly connect with the second and third conductive plates respectively, so as to make the power switch suitable for automated production.

8 Claims, 6 Drawing Sheets

POWER SWITCH SUITABLE FOR AUTOMATED PRODUCTION

FIELD OF THE INVENTION

The present invention relates to a power switch, more particularly to a power switch having a light-emitting unit which can be easily installed to the power switch in a way for saving the time, labor, and materials required for producing the power switch in an automated production and, in the meanwhile, increasing the safety of use.

BACKGROUND OF THE INVENTION

As more and more electric appliances are brought to the market, the various electric appliances have played an increasingly important role in our daily lives. However, fire accidents caused by such appliances have also become an issue. According to the National Fire Agency of Taiwan's Ministry of the Interior, the total number of reported fire accidents in Taiwan in 2010 is 2186, of which more than one third, or 744 cases, can be attributed to electric appliances. Therefore, in order to create a safer living environment, it is imperative for the general public to have proper concepts and habits regarding the use of electricity and to choose electric appliances that are safe in design. Generally speaking, an electric appliance is almost always provided with a power switch for controlling the electric current flowing into and out of the appliance, so that users can switch on and off the appliance conveniently.

Referring to FIG. 1, a conventional power switch 1 includes a housing 11, a key 12, a first conductive plate 131, a second conductive plate 132, a thermally actuated metal plate 14, a C-shaped spring 15, a third conductive plate 133, a light-emitting unit 16, and a pressing element 17. The housing 11 forms a receiving space 111 therein and has an opening 112 on the top surface, wherein the opening 112 communicates with the receiving space 111. The middle portion of the key 12 is pivotally connected to the inner periphery of the opening 112. The bottom of the key 12 is provided with a first pushing portion 121 and a second pushing portion 121, which two pushing portions are proximate to two opposite ends of the key 12 respectively and are received in the receiving space 111.

As shown in FIG. 1, the first conductive plate 131 is fixedly provided adjacent to an inner lateral side of the housing 11. The top end of the first conductive plate 131 is received in the receiving space 111 and provided with a first contact P3. The bottom end of the first conductive plate 131 extends out of the bottom surface of the housing 11. The second conductive plate 132 is fixedly provided on the housing 11 and has a bottom end extending out of the bottom surface of the housing 11 and a top end received in the receiving space 111. The thermally actuated metal plate 14 has one end fixed to the top end of the second conductive plate 132 and a free end extending toward the lateral side of the housing 11 where the first conductive plate 131 is located. Referring to FIG. 2, the thermally actuated metal plate 14 is formed with a generally U-shaped groove 141 which defines a resilient tongue 142 of the thermally actuated metal plate 14. The free end of the resilient tongue 142 extends toward the second conductive plate 132 and can move above or below the groove 141 when the free end of the thermally actuated metal plate 14 is subjected to or not subjected to an applied force. A second contact P4 is provided on the resilient tongue 142, proximate to the free end thereof, and corresponds in position to the first contact P3 (see FIG. 1). The C-shaped spring 15 has one end engaged with the free end of the resilient tongue 142 and an opposite end engaged with the end of the thermally actuated metal plate 14 that is connected to the second conductive plate 132. As shown in FIG. 1, the C-shaped spring 15 corresponds in position to the first pushing portion 121 so that when the first pushing portion 121 is moved downward, the C-shaped spring 15 is pushed by the first pushing portion 121 and hence drives the free end of the resilient tongue 142 downward, thereby bringing the second contact P4 into electrical connection with the first contact P3. When the second pushing portion 122 is moved downward, the free end of the thermally actuated metal plate 14 is pushed downward by the second pushing portion 122 and generates a resilient restoring force that drives the free end of the resilient tongue 142 upward; as a result, the second contact P4 is separated from the first contact P3.

Referring to FIGS. 1 and 2, the third conductive plate 133 is fixedly provided proximate to an opposite inner lateral side of the housing 11. The top end of the third conductive plate 133 is located in the receiving space 111 while the bottom end of the third conductive plate 133 extends out of the bottom surface of the housing 11. The light-emitting unit 16 is housed in the key 12 and has two electrodes 161 respectively and electrically connected to the second conductive plate 132 and the third conductive plate 133. The pressing element 17 has one end pressing against the electrode 161 that is connected to the second conductive plate 132 and an opposite end pressing against the third conductive plate 133. The pressing element 17 includes a spring 171 and an insulating rod 172. Due to the spring 171, the electrode 161 that is connected to the second conductive plate 132 is pressed tightly against the second conductive plate 132. The insulating rod 172, on the other hand, prevents the pressing element 17 from connecting the second conductive plate 132 and the third conductive plate 133 electrically.

The temperature of the thermally actuated metal plate 14 rises when the power switch 1 is turned on, and the rise in the temperature varies with the current flowing through the thermally actuated metal plate 14 per unit time. Once the temperature of the thermally actuated metal plate 14 reaches a memory temperature, the thermally actuated metal plate 14 begins to deform. Therefore, referring to FIG. 2, should the current through the power switch 1 exceed a rated current, the thermally actuated metal plate 14 will deform in such a way that the resilient tongue 142 springs upward and causes separation of the first contact P3 and the second contact P4. In other words, the power switch 1 will be automatically turned off upon a current overload, with a view to protecting the circuit of the electric appliance connected to the safety switch 1.

While power switches similar to the power switch 1 are now in extensive use, the power switch 1 still has certain drawbacks in terms of production, as explained below with reference to FIGS. 1 and 2:

(1) As the light-emitting unit 16 is configured to have one electrode 161 clamped between the third conductive plate 133 and the inner wall of the housing 11 and the other electrode 161 clamped between the second conductive plate 132 and the spring 171, the assembly process must be conducted slowly and carefully to ensure proper electrical connection between the light-emitting unit 16, the second conductive plate 132, and the third conductive plate 133. Besides, an assembly worker often has to move several components in order to install one, thus lowering production efficiency.

(2) The foregoing assembly process cannot be done other than manually, so the quality of assembly depends mainly on the assembly workers' experience. To achieve a high yield rate, a manufacturer must take considerable time training the assembly workers, which nevertheless results in high labor costs.

(3) Given the current design trend of the power switch 1 toward increased compactness, the interior space of the housing 11 is very limited. Because of that, the electrodes 161 of the light-emitting unit 16 are often bent to save space. However, if the electrodes 161 are bent so much that they contact with the C-shaped spring 15, short circuits will occur. To prevent such short circuits, the electrodes 161 must be parted during assembly to avoid contact with the C-shaped spring 15, and this explains why the adjustment of the electrodes 161 always takes a lot of time and effort. The manual adjustment also hinders automated installation of the light-emitting unit 16 and compromises the yield rate of the power switch 1. Moreover, the light-emitting unit 16 tends to shake slightly when the key 12 is moved back and forth. As time goes on, the accumulated effect of such slight shakes may bring the electrodes 161 closer to, or even into contact with, the C-shaped spring 15, thereby causing dangerous short circuits.

(4) The second conductive plate 132 must be bent several times so as for its top end to serve as a supporting surface for the thermally actuated metal plate 14, and for its bottom end to extend out of the housing 11 and be adequately spaced from the first and the third conductive plates 131, 133. This bent structure of the second conductive plate 132, however, requires the use of more material than a straight structure and incurs higher material costs. Additionally, as the lower bent portion of the second conductive plate 132 is adjacent to the top end of the first conductive plate 131, the first conductive plate 131, if tilted when installed, is very likely to contact with the second conductive plates 132, thus rendering the power switch 1 useless. Furthermore, if the power switch 1 is used in a circuit configured for a large current, an electric arc may take place between the first and the second conductive plates 131, 132 should the lower bent portion of the second conductive plate 132 be too close to the first conductive plate 131. Such electric arcs are severe safety hazards because they not only can damage the power switch 1 but also may cause fire accidents.

Please refer to FIG. 3 for the structure of another conventional power switch 2, which includes a key 22 having a pivot hole 221 at one end. The pivot hole 221 is pivotally connected with one end of a push/pull bar 25. The other end of the push/pull bar 25 passes through a through hole (not shown) of a thermally actuated metal plate 24 and is engaged with the free end of the thermally actuated metal plate 24. When the key 22 is pressed, the push/pull bar 25 is driven by the key 22 to push or pull the thermally actuated metal plate 24, causing the free end of the thermally actuated metal plate 24 to swing up or down, and a resilient tongue 241 of the thermally actuated metal plate 24 to swing correspondingly. As a result, a second contact P6 which is provided at the free end of the resilient tongue 241 is separated from or brought into contact with a first contact P5 at the top end of a first conductive plate 231. This conventional power switch 2 has the same drawbacks as the power switch 1, as explained in further detail below:

(1) Referring to FIG. 3, the power switch 2 has a light-emitting unit 26 whose two electrodes 261 are respectively clamped between a second conductive plate 232 and the inner wall of a housing 21 and between a third conductive plate 233 and the inner wall of the housing 21. Therefore, during the manufacturing process, an assembly worker must place the light-emitting unit 26 in the housing 21 and then insert the electrodes 261 in place while bending the electrodes 261 carefully. After that, the second conductive plate 232 and the third conductive plate 233 are assembled to the housing 21. In particular, the assembly worker must grip the free end of each electrode 261 and route the electrodes 261 below the second and the third conductive plates 232, 233 respectively, so as to ensure that the electrodes 261 are held in place by the two conductive plates 232, 233 respectively. If the second conductive plate 232 or the third conductive plate 233, once assembled to the housing 21, fails to hold the corresponding electrode 261 in position, the assembly worker must detach the conductive plate in question from the housing 21 and install it again. The detachment and reinstallation process not only lowers production efficiency but also may damage the components involved, thus incurring additional costs.

(2) As the key 22 relies on the push/pull bar 25 to drive the thermally actuated metal plate 24 and thereby connect or separate the first and the second contacts P5, P6, the distance between the two ends of the push/pull bar 25 is crucial to the operation of the switch 2. If the distance is too great, the push/pull bar 25 will have problem pulling the thermally actuated metal plate 24; as a result, the second contact P6 will never contact with the first contact P5. If the distance between the two ends of the push/pull bar 25 is too small, the push/pull bar 25 cannot push the thermally actuated metal plate 24 properly, and because of that, the second contact P6 will not separate from the first contact P5. Since the push/pull bar 25 is a slender and hence rather fragile metal rod, it cannot be installed by an automated process. The assembly worker must take extra care in order not to bend the push/pull bar 25; otherwise, the distance between the two ends of the push/pull bar 25 may be altered, which is detrimental to the function of the switch 2.

(3) The assembly process described above must be carried out by hand and therefore relies heavily on the assembly workers' experience. In order to increase yield rate, a manufacturer must spend a lot of time training the assembly workers, and yet high labor costs ensue.

(4) The second conductive plate 232 must be bent several times so that its top end provides a supporting surface for the thermally actuated metal plate 24 and its bottom end extends out of the housing 21 and is properly spaced from the first and the third conductive plates 231, 233. This bent structure, however, increases the material required for making the second conductive plate 232 and thus incurs a high production cost.

The foregoing switches are only two examples of the conventional power switches. The various conventional power switches on the market, though different in design, have more or less the same drawbacks that make automated production impossible; consequently, the burden of high labor costs cannot be relieved from the manufacturers' shoulders. The soaring prices of metals also contribute to high material costs. More importantly, the conventional power switches have safety concerns that have yet to be properly addressed. Hence, it is a pressing issue for power switch designers and manufacturers to simplify the overall design and components of a power switch so that a light-emitting unit can be easily installed in the power switch by an automated process, thus not only reducing the labor and material costs of the power switch, but also preventing short circuits which may otherwise occur if the two electrodes of the light-emitting unit contact with a C-shaped spring.

BRIEF SUMMARY OF THE INVENTION

In view of the drawbacks of the conventional power switches—namely an overly complicated structure that compromises yield rate and increases the difficulty in assembly, and the risks of short circuits caused by contact between the two electrodes of a light-emitting unit and a C-shaped spring—the inventor of the present invention conducted extensive research and experiment and finally succeeded in developing a power switch suitable for automated production. The present invention proposes a simplified power switch structure in which a light-emitting unit can be easily installed and whose third conductive plate is made of less metal material than in the prior art. Moreover, as the two electrodes of the light-emitting unit will never contact with a C-shaped spring, short circuits otherwise attributable to such contact are effectively prevented, and the time and effort otherwise required for adjusting the electrodes during the assembly process can be spared. Thus, the present invention saves the time, labor, and materials required for producing power switches and, on top of that, increases safety of use.

It is an object of the present invention to provide a power switch suitable for automated production, wherein the power switch includes a housing, a key, a first conductive plate, a thermally actuated metal plate, a C-shaped spring, a second conductive plate, an insulating seat, a light-emitting unit, and a third conductive plate. The housing forms a receiving space therein and has a top surface provided with an opening communicating with the receiving space. The middle portion of the key is pivotally connected to the inner periphery of the opening. The bottom of the key is provided with a first pushing portion and a second pushing portion, wherein the two pushing portions are proximate to two opposite ends of the key respectively and are received in the receiving space. The first conductive plate is fixedly provided adjacent to an inner lateral side of the housing. The top end of the first conductive plate is received in the receiving space while the bottom end of the first conductive plate extends out of the bottom surface of the housing. The thermally actuated metal plate has one end fixed to the top end of the first conductive plate and a free end extending toward an opposite inner lateral side (hereinafter referred to as the second inner lateral side) of the housing. The thermally actuated metal plate is formed with a generally U-shaped groove that defines a resilient tongue of the thermally actuated metal plate. The resilient tongue has a free end extending toward the first conductive plate. The free end of the resilient tongue can move above or below the groove when the free end of the thermally actuated metal plate is subjected to or not subjected to an applied force. In addition, a first contact is provided on the resilient tongue and proximate to the free end thereof. The C-shaped spring has one end engaged with the free end of the resilient tongue and an opposite end engaged with the end of the thermally actuated metal plate that is connected to the first conductive plate. Moreover, the C-shaped spring corresponds in position to the first pushing portion. The second conductive plate is fixedly provided on the housing. The top end of the second conductive plate is received in the receiving space and provided with a second contact corresponding in position to the first contact. The bottom end of the second conductive plate extends out of the bottom surface of the housing. When the first pushing portion is moved downward, the C-shaped spring is pushed by the first pushing portion and therefore drives the free end of the resilient tongue downward; as a result, the free end of the resilient tongue is moved to a position below the groove to make electrical connection between the first contact and the second contact. When the second pushing portion is moved downward, the free end of the thermally actuated metal plate is moved downward by the second pushing portion and hence generates a resilient restoring force that drives the free end of the resilient tongue upward; consequently, the first contact is separated from the second contact.

The insulating seat is received in the receiving space and adjacent to the second inner lateral side of the housing. The light-emitting unit is located in the key and has two electrodes connected to the insulating seat such that the light-emitting unit and the insulating seat form a single piece. One of the electrodes is pressed against the second conductive plate, and the other electrode (hereinafter referred to as the second electrode) is exposed on the bottom of the insulating seat. The third conductive plate is fixedly provided adjacent to the second inner lateral side of the housing. The top end of the third conductive plate lies against the bottom of the insulating seat and is connected to the second electrode of the light-emitting unit. The bottom end of the third conductive plate extends out of the bottom surface of the housing.

Compared with the conventional power switches, the power switch described above has substantially simplified components to facilitate installation of the light-emitting unit. More specifically, the power switch can be manufactured by an automated process that begins by connecting the electrodes of the light-emitting unit to the insulating seat and then installs all the components into the housing. Thus, the assembly process is simple and smooth and spares the time and effort otherwise required in a complicated assembly operation, such as manual adjustment of the electrodes of the light-emitting unit to avoid contact with the C-shaped spring. In a nutshell, the power switch disclosed herein is suitable for automated production. Furthermore, the material required for making the third conductive plate is substantially reduced, so the production cost of the power switch can be effectively cut. Now that the two electrodes of the light-emitting unit will by no means contact with the C-shaped spring, short circuits otherwise attributable to such contact are also effectively prevented. Therefore, the present invention not only saves time, effort, and materials during the manufacturing process, but also enhances safety of use.

It is another object of the present invention to provide the foregoing power switch, wherein the housing is further provided therein with a plurality of positioning grooves corresponding in configuration to the top ends of the first and the second conductive plates respectively, so that the first and the second conductive plates can be securely assembled to the housing. With the top ends of the first and the second conductive plates being positioned in the positioning grooves respectively, the bending angles of both conductive plates will not be altered during the assembly process as a result of the elasticity of the metal material of which these conductive plates are made; hence, the distance between the first and the second contacts is prevented from deviating from the design value. More particularly, the two contacts will not be rendered so far apart that they cannot contact with each other to make a circuit. Nor will the two contacts be so close that, should a current overload take place, the thermally actuated metal plate cannot separate the first contact from the second contact to prevent safety hazards.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
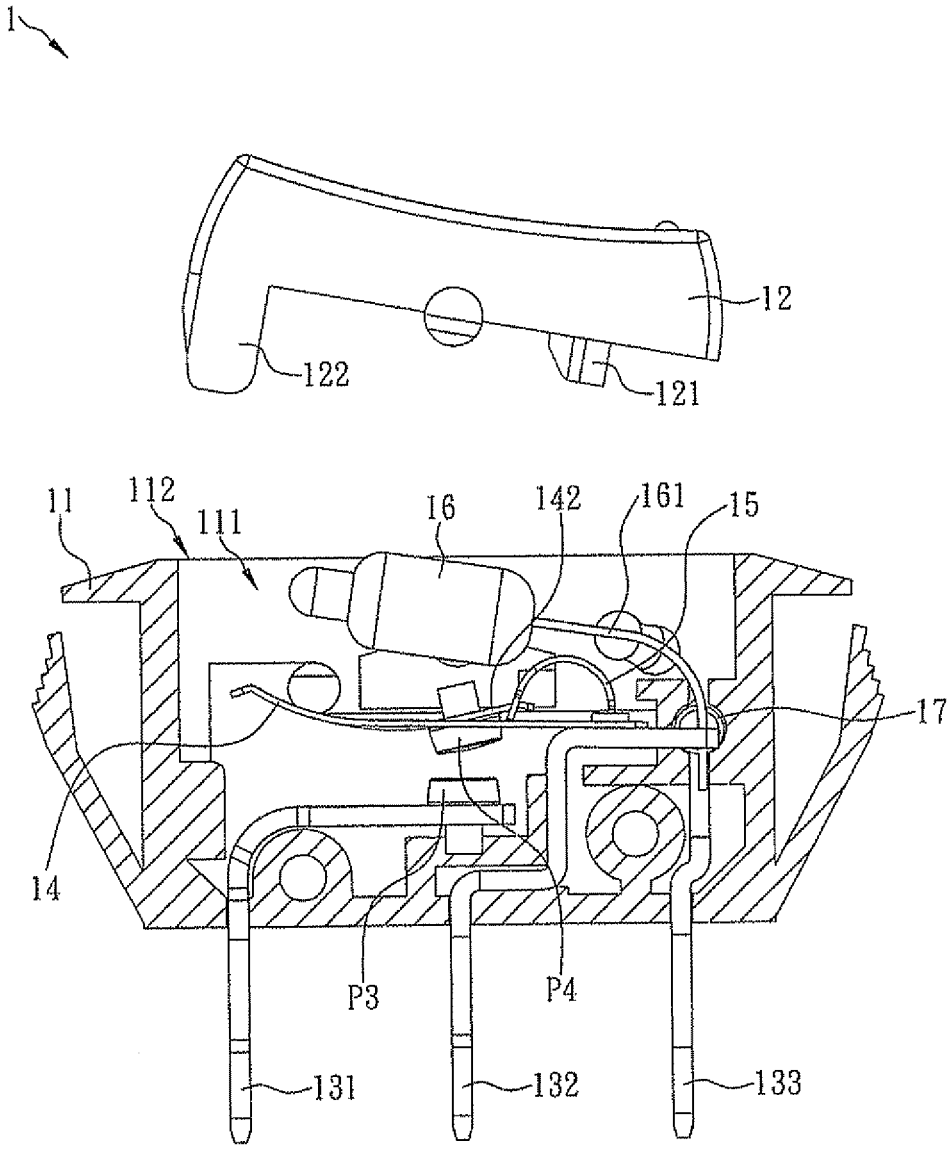
FIG. 1 (Prior Art)
FIG. 1 is a sectional view of a conventional power switch.
Figure 2:
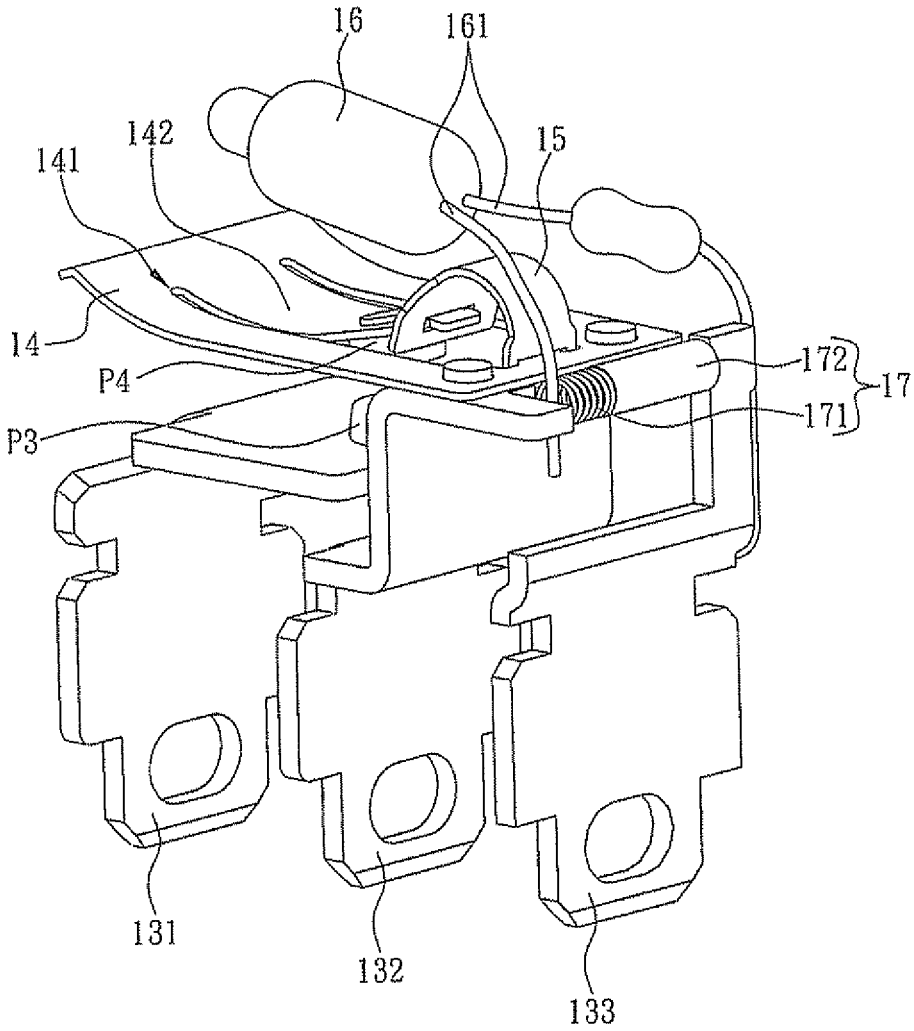
FIG. 2 (Prior Art)
FIG. 2 is an assembled perspective view of some components of the conventional power switch depicted in FIG. 1.
Figure 3:
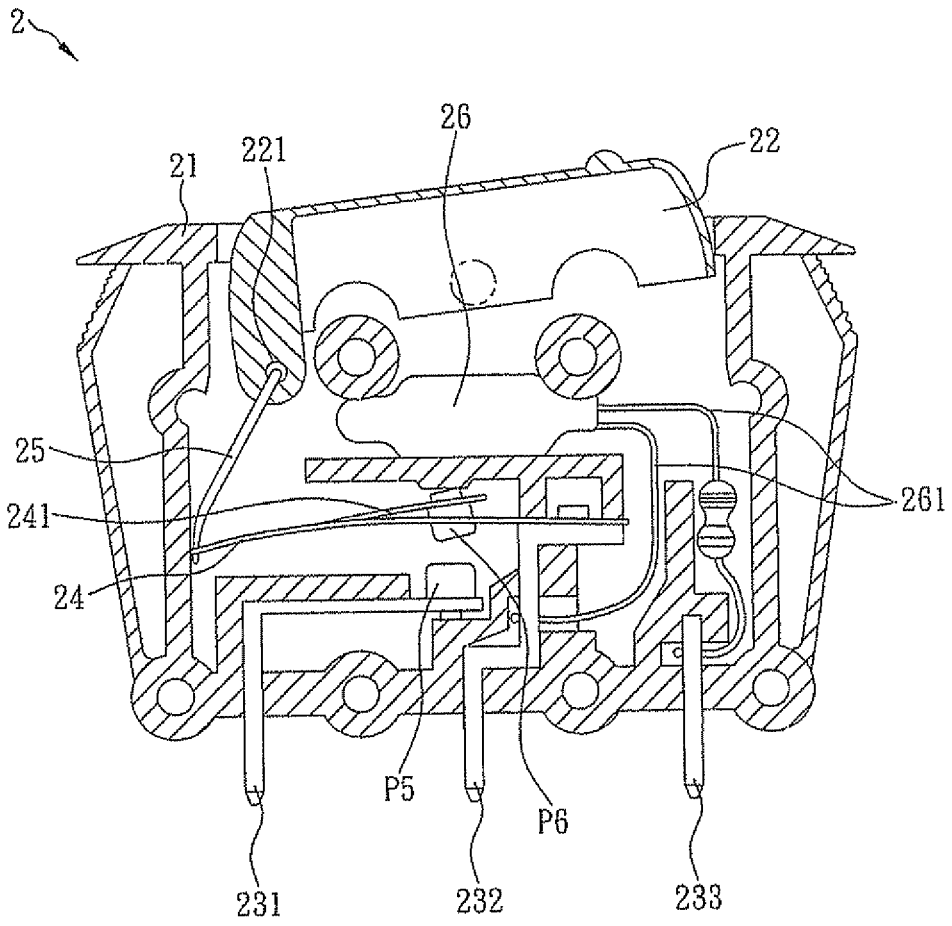
FIG. 3 (Prior Art)
FIG. 3 is a sectional view of another conventional power switch.
Figure 4:
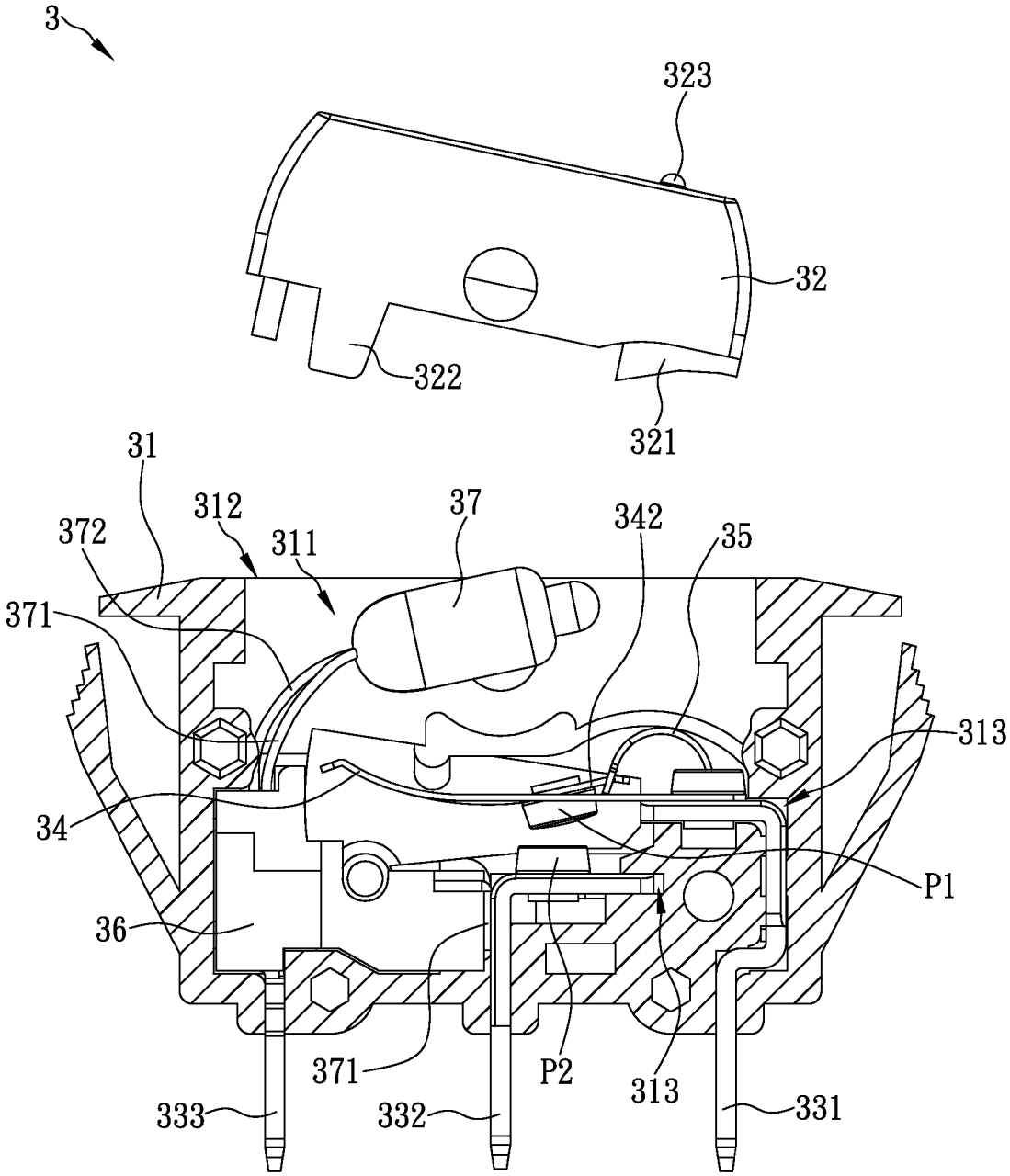
FIG. 4 is a sectional view of a power switch according to the present invention.

The present invention discloses a power switch suitable for automated production. Referring to FIG. 4, a power switch 3 according to the present invention includes a housing 31, a key 32, a first conductive plate 331, a thermally actuated metal plate 34, a C-shaped spring 35, a second conductive plate 332, an insulating seat 36, a light-emitting unit 37, and a third conductive plate 333. The housing 31 forms a receiving space 311 therein. The top surface of the housing 31 has an opening 312 in communication with the receiving space 311. The bottom of the housing 31 is provided with a plurality of positioning grooves 313 that are open outward. The key 32 has a middle portion pivotally connected to the inner periphery of the opening 312. The key 32 also has a bottom provided with a first pushing portion 321 and a second pushing portion 322, which two pushing portions are proximate to two opposite ends of the key 32 respectively and are received in the receiving space 311. The key 32 further has a light-permeable portion 323.

Figure 5:
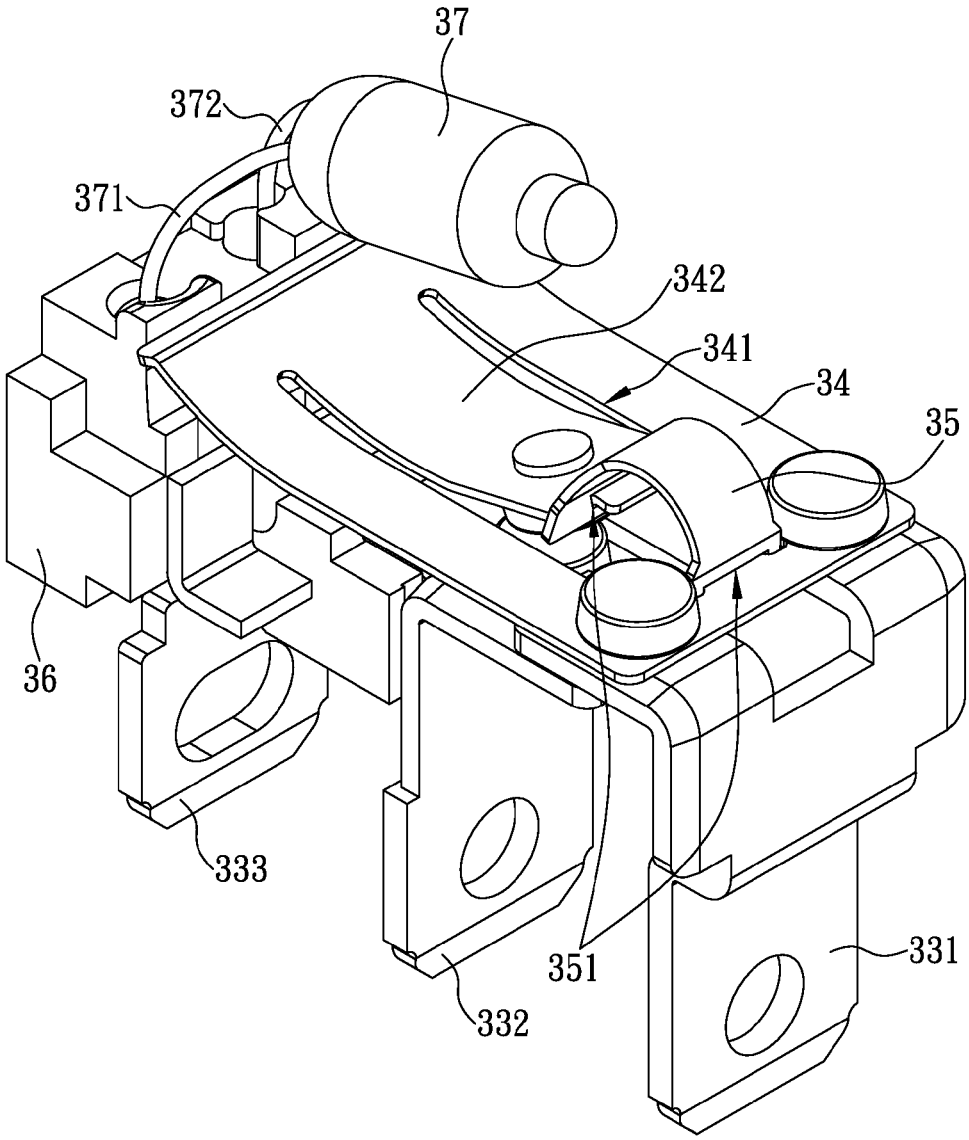
FIG. 5 is an assembled perspective view of some components of the power switch depicted in FIG. 4.

The first conductive plate 331 is fixedly provided at a position adjacent to an inner lateral side of the housing 31. The top end of the first conductive plate 331 is received in the receiving space 311 and positioned in one of the positioning grooves 313. The bottom end of the first conductive plate 331 extends out of the bottom surface of the housing 31. The thermally actuated metal plate 34 has one end fixedly connected to the top end of the first conductive plate 331 and a free end extending toward an opposite inner lateral side (hereinafter referred to as the second inner lateral side) of the housing 31. As shown more clearly in FIG. 5, the thermally actuated metal plate 34 is formed with a generally U-shaped groove 341 that defines a resilient tongue 342 of the thermally actuated metal plate 34. The resilient tongue 342 has a free end extending toward the first conductive plate 331. The free end of the resilient tongue 342 can move above or below the groove 341 when the free end of the thermally actuated metal plate 34 is subjected to or not subjected to an applied force. Also, referring back to FIG. 4, a first contact P1 is provided on the resilient tongue 342 at a position adjacent to the free end of the resilient tongue 342. The C-shaped spring 35 corresponds in position to the first pushing portion 321 and has two ends each formed with an engaging hole 351. The engaging hole 351 at one end of the C-shaped spring 35 is engaged with the free end of the resilient tongue 342, while the engaging hole 351 at the other end of the C-shaped spring 35 is engaged with the end of the thermally actuated metal plate 34 that is fixedly connected to the first conductive plate 331. The second conductive plate 332 is fixedly provided on the housing 31 via another one of the positioning grooves 313. The top end of the second conductive plate 332 is received in the receiving space 311 and provided with a second contact P2 that corresponds in position to the first contact P1. The bottom end of the second conductive plate 332 extends out of the bottom surface of the housing 31. When the first pushing portion 321 is moved downward, the C-shaped spring 35 is pushed by the first pushing portion 321 and hence drives the free end of the resilient tongue 342 downward to a position below the groove 341; thus, the first contact P1 is brought into electrical connection with the second contact P2. When the second pushing portion 322 is moved downward, the free end of the thermally actuated metal plate 34 is pushed downward by the second pushing portion 322 and therefore generates a resilient restoring force that raises the free end of the resilient tongue 342 upward. As a result, the first contact P1 is separated from the second contact P2.

Figure 6:
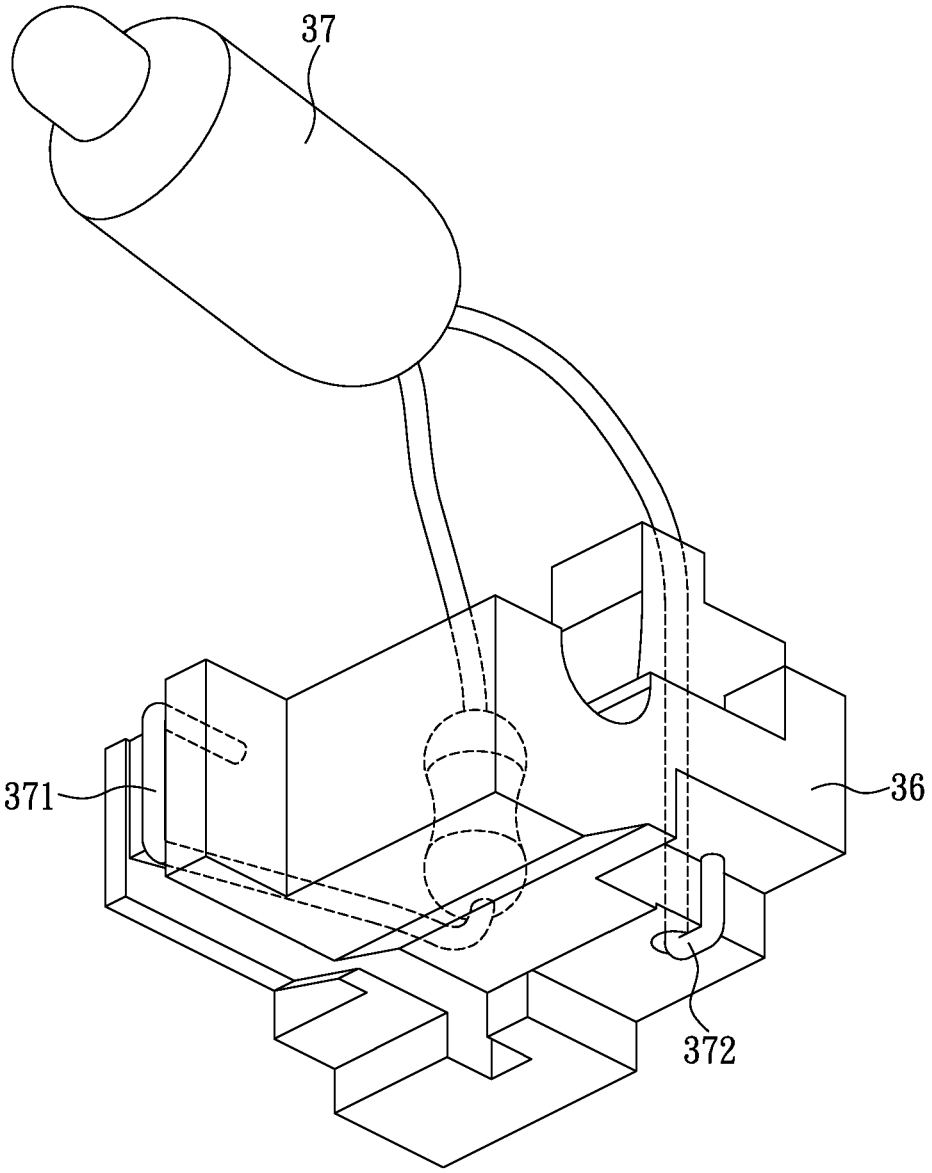
FIG. 6 is an assembled perspective view of a light-emitting unit and an insulating seat according to the present invention.

The insulating seat 36 is received in the receiving space 311 and adjacent to the second inner lateral side of the housing 31. The light-emitting unit 37 is located in the key 32, but the light emitted by the light-emitting unit 37 can be seen from outside the power switch 3 through the light-permeable portion 323. As shown in the embodiment of FIG. 6, the light-emitting unit 37 has two electrodes 371 passing through the insulating seat 36. More particularly, one of the electrodes 371 lies against the second conductive plate 332 (see FIG. 4), and the other electrode 371 (hereinafter referred to as the second electrode 371) juts out from the bottom of the insulating seat 36. However, the connection between the light-emitting unit 37 and the insulating seat 36 is not limited to that described above. For instance, the insulating seat 36 can be formed with surface channels that run in different directions, and the electrodes 371 are fitted in the channels respectively before the insulating seat 36 is put into the housing 31 (see FIG. 4). In that case, the housing 31 can be further provided with a plurality of projections corresponding in shape to the channels so as to secure the insulating seat 36 in the receiving space 311 (see FIG. 4) and thereby fix the electrodes 371 in place. All equivalent changes which are based on the technical contents disclosed herein and readily conceivable by a person skilled in the art should fall within the scope of the present invention. Referring to FIG. 4, the third conductive plate 333 is fixedly provided adjacent to the second inner lateral side of the housing 31. The top end of the third conductive plate 333 is pressed against the bottom of the insulating seat 36 and connected to the second electrode 371 of the light-emitting unit 37. The bottom end of the third conductive plate 333 extends out of the bottom surface of the housing 31.

The components of the power switch 3 have much simpler structures than those of their prior art counterparts so that the light-emitting unit 37 can be easily installed in the power switch 3. Besides, the third conductive plate 333 is so configured that it can be made of less metal material than in the prior art. As the two electrodes 371 of the light-emitting unit 37 are kept from making any contact with the C-shaped spring 35, short circuits which may otherwise result from such contact are effectively prevented. The time and effort otherwise required to adjust each electrode 371 during the assembly process in order to avoid contact with the C-shaped spring 35 can also be spared. Thus, the present invention increases the safety of use of power switches while saving the time, effort, and materials needed in their production.

While the invention herein disclosed has been described by means of specific embodiments, numerous modifications and variations could be made thereto by those skilled in the art without departing from the scope of the invention set forth in the claims.

What is claimed is:

1. A power switch suitable for automated production, comprising:

a housing defining a receiving space therein and having a top surface formed with an opening in communication with the receiving space;

a key having a middle portion pivotally connected to an inner periphery of the opening, the key having a bottom provided with a first pushing portion and a second pushing portion, wherein the first pushing portion and the second pushing portion are proximate to two opposite ends of the key respectively and are received in the receiving space;

a first conductive plate fixedly provided adjacent to a first inner lateral side of the receiving space and having a top end received in the receiving space and a bottom end extending out of a bottom surface of the housing;

a thermally actuated metal plate having an end fixedly connected to the top end of the first conductive plate and a free end extending toward a second inner lateral side of the receiving space, the second inner lateral side being opposite to the first inner lateral side, the thermally actuated metal plate being formed with a groove which defines a resilient tongue of the thermally actuated metal plate, the resilient tongue having a free end which extends toward the first conductive plate and is movable above or below the groove when the free end of the thermally actuated metal plate is subjected to or not subjected to an applied force, the resilient tongue being provided with a first contact proximate to the free end of the resilient tongue;

a C-shaped spring having an end connected to the free end of the resilient tongue and an opposite end connected to the end of the thermally actuated metal plate that is fixedly connected to the first conductive plate, the C-shaped spring corresponding in position to the first pushing portion;

a second conductive plate fixedly provided on the housing at a position between the first and second inner lateral sides of the receiving space and having a top end received in the receiving space and a bottom end extending out of the bottom surface of the housing, the top end of the second conductive plate being provided with a second contact corresponding in position to the first contact so that when the first pushing portion is moved downward, the C-shaped spring is pushed by the first pushing portion and hence drives the free end of the resilient tongue downward to a position below the groove, thereby bringing the first contact into electrical connection with the second contact, and when the second pushing portion is moved downward, the free end of the thermally actuated metal plate is pushed downward by the second pushing portion and hence drives the free end of the resilient tongue upward, thereby separating the first contact from the second contact;

an insulating seat received in the receiving space and proximate to the second inner lateral side of the receiving space;

a light-emitting unit provided in the key and having two electrodes inserted in and passing through the insulating seat respectively, wherein an end of the first electrode lies against the second conductive plate, and an end of the second electrode is exposed on a bottom of the insulating seat; and a third conductive plate fixedly provided adjacent to the second inner lateral side of the receiving space and having a top end pressed against the bottom of the insulating seat and connected to the end of the second electrode of the light-emitting unit and a bottom end extending out of the bottom surface of the housing.

2. The power switch of claim 1, wherein the housing is provided therein with a plurality of positioning grooves corresponding in configuration to the top end of the first conductive plate and the top end of the second conductive plate respectively, and the first conductive plate and the second conductive plate are positioned on the housing via the positioning grooves.

3. The power switch of claim 2, wherein each said end of the C-shaped spring is formed with an engaging hole for engaging with the free end of the resilient tongue or the end of the thermally actuated metal plate that is fixedly connected to the first conductive plate.

4. The power switch of claim 3, wherein the key has a light-permeable portion corresponding in position to the light-emitting unit.

5. The power switch of claim 4, wherein the groove is generally U-shaped.

6. The power switch of claim 1, wherein each said end of the C-shaped spring is formed with an engaging hole for engaging with the free end of the resilient tongue or the end of the thermally actuated metal plate that is fixedly connected to the first conductive plate.

7. The power switch of claim 6, wherein the key has a light-permeable portion corresponding in position to the light-emitting unit.

8. The power switch of claim 7, wherein the groove is generally U-shaped.

* * * * *